United States Patent [19]

Gaughf, Jr.

[11] 4,124,937

[45] Nov. 14, 1978

[54] IMPROVED NOTCHING SHEAR FOR NOTCHING WOVEN TEXTILE FABRIC OR OTHER FLEXIBLE OR PLIABLE SHEET MATERIAL

[76] Inventor: Orvis O. Gaughf, Jr., 14216 Chesterfield Rd., Rockville, Md. 20853

[21] Appl. No.: 760,175

[22] Filed: Jan. 17, 1977

[51] Int. Cl.[2] ..... B26B 13/00

[52] U.S. Cl. ..... 30/229; 83/693; 83/917

[58] Field of Search ..... 144/216, 217; 30/446, 30/430, 443, 229, 178, 230, 211; 83/693, 917

[56] References Cited

U.S. PATENT DOCUMENTS

| | | | |
|---|---|---|---|
| 270,967 | 1/1883 | Merriam | 30/229 |
| 1,531,287 | 3/1925 | Jensen | 83/693 X |

*Primary Examiner*—Willie G. Abercrombie

[57] ABSTRACT

My invention relates to a hand operated notch cutting tool that will notch woven fabric, pliable or other thin material.

2 Claims, 1 Drawing Figure

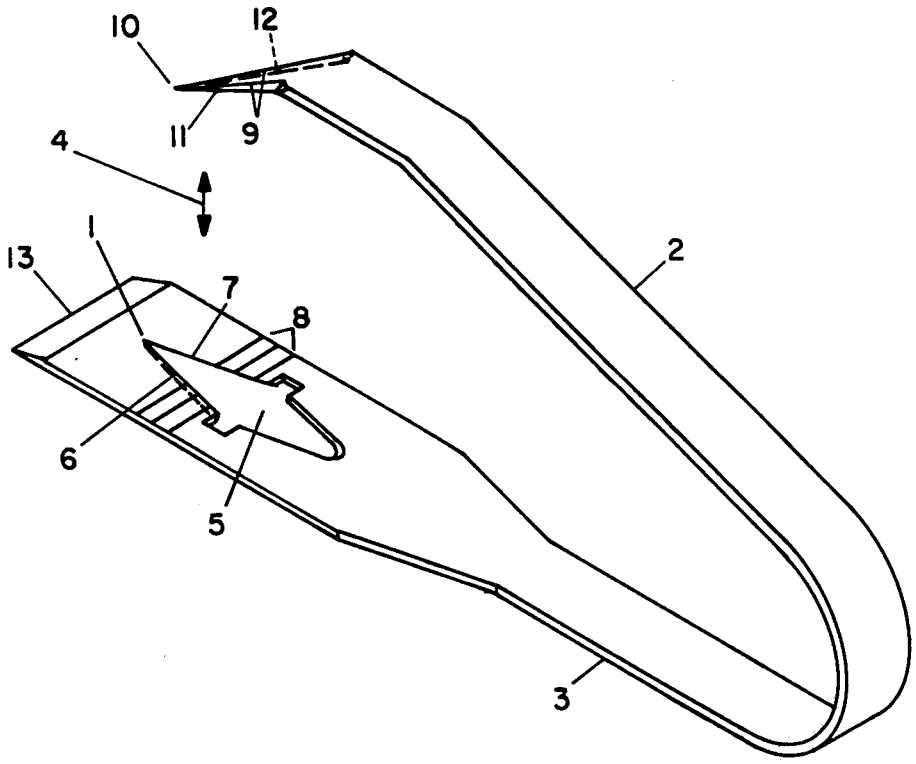
10
12
11
9
4
1
13
7
8
2
6
5
3

IMPROVED NOTCHING SHEAR FOR NOTCHING WOVEN TEXTILE FABRIC OR OTHER FLEXIBLE OR PLIABLE SHEET MATERIAL

SUMMARY OF THE INVENTION

In the prior art, notching woven fabric, pliable or other thin material required that two separate, angular intersecting, cuts be made in two separate cutting operations. It is an object of my invention to create a hand operated notch cutting tool that will cut a complete notch in a single cutting action.

In the drawing, the single FIGURE illustrates a perspective of the notch cutting tool.

DESCRIPTION OF THE INVENTION

The tool is fabricated from a single blank of stock tool material. It is shaped in manufacture to feature an upper tool element 2 over a lower tool element 3 with space 4 between the two elements to place therein the workpiece material that is intended to be notched. The end of the lower tool element is tapered as indicated at 13 in a manner to facilitate sliding the lower tool element underneath workpiece material that may be at rest on a flat surface; however, be it known that the tool may be efficiently operated in any direction or plane and no mobility or directional limitation is imposed on either the tool or the workpiece material. The lower tool element has a portion of tool material removed in manufacture leaving in it's place an aperture 5 a part of which is in form of a notch shape, said shape being triangular. The edges 6 and 7 of the aperture that define the notch shape are then beveled to create sharp cutting edges. Indices 8 are etched on the upper surface of the lower tool element to aid in the alignment of the workpiece material permitting the operator to control the size of the notch that is cut in the workpiece material when the tool is operated. Located above the lower tool element is an upper tool element 2 with space 4 between the upper and lower tool elements to place workpiece material to be notched. The periphery 9 of the upper tool element is formed in the notch shape, said shape being triangular, that features at it's apex 10 a very sharp point for the purpose of penetrating through workpiece material, when the tool is operated, at the point on the material that the operator selects as the notch apex, thence passing through the apex 1 of the notch aperture in the lower tool element. The upper tool element edges 11 and 12 are beveled to create sharp cutting edges that extend rearwardly from the sharp point and are designed to coact with the cutting edges of the lower tool element to provide a shearing cut. Upon operating the tool in the notch cutting process a relative coaction is commenced between the upper and lower tool elements whereby the sharp point of the upper tool element penetrates through the workpiece material continuing to enter and pass through the apex of the aperture in the lower tool element wherepon the sharp cutting edges of the upper tool element commences to move downward between and presses laterally against while sliding alongside the sharp cutting edges of the lower tool element thereby gripping the workpiece material caught therebetween and in continuation severs the notch plug from the workpiece material by scissors type cuts in a single action of the tool.

What I claim is:

1. A hand operated notch cutting tool comprising an upper element and a lower element, said upper and lower elements being movable relative to each other, said lower element having an aperture therein, said aperture being defined in part by beveled cutting edges, said edges extending rearwardly from an apex to define a triangular notch shape in part, the upper element having a triangular shaped portion with some of the edges thereof being beveled to form upper cutting edges wherein upon relative movement therebetween, the upper cutting edges coact with the lower cutting edges to sever a triangular piece of material therebetween, the severing beginning at the apex and extending rearwardly to notch material placed between the upper and lower elements.

2. The tool as defined in claim 1, wherein the lower element has a tapered edge thereon to facilitate moving the element under material to be notched.

* * * * *